US008350876B2

(12) United States Patent
Yoshikawa et al.

(10) Patent No.: US 8,350,876 B2
(45) Date of Patent: Jan. 8, 2013

(54) IMAGE FORMING APPARATUS, IMAGE FORMING METHOD, AND STORAGE MEDIUM IN WHICH ABNORMALITY JUDGING PROGRAM IS STORED

(75) Inventors: Hayato Yoshikawa, Kanagawa (JP); Yasuhiro Arai, Kanagawa (JP); Masaki Fujise, Kanagawa (JP); Kenji Koizumi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 640 days.

(21) Appl. No.: 12/564,941

(22) Filed: Sep. 23, 2009

(65) Prior Publication Data

US 2010/0248098 A1 Sep. 30, 2010

(30) Foreign Application Priority Data

Mar. 24, 2009 (JP) ..... 2009-071356

(51) Int. Cl.
*B41J 2/385* (2006.01)
*G03G 15/043* (2006.01)

(52) U.S. Cl. ..... 347/111; 399/51

(58) Field of Classification Search ..... 347/232, 347/116, 111; 348/365, 701, 129; 430/22; 369/100; G9B/7; 399/51
See application file for complete search history.

(56) References Cited

U.S. PATENT DOCUMENTS

| | | | | |
|---|---|---|---|---|
| 5,189,519 | A * | 2/1993 | Miyamoto et al. | 348/365 |
| 6,456,337 | B1 * | 9/2002 | Kobayashi et al. | 348/701 |
| 2001/0028387 | A1 * | 10/2001 | Maeda | 347/232 |
| 2004/0160506 | A1 * | 8/2004 | Maeda | 347/129 |

FOREIGN PATENT DOCUMENTS

JP 2004-334075 A 11/2004

* cited by examiner

*Primary Examiner* — Stephen Meier
*Assistant Examiner* — Carlos A Martinez
(74) *Attorney, Agent, or Firm* — Sughrue Mion, PLLC

(57) ABSTRACT

An image forming apparatus is provided. An exposure component is equipped with a plurality of light emitting elements arrayed along a first direction. An output component is equipped with output ends corresponding to each of the light emitting elements and the output component, when correcting an amount of misalignment in the first direction, outputs drive signals of one line corresponding to a line on a most upstream side of drive signals of plural lines from the output ends that have been shifted by a number corresponding to the amount of misalignment in the first direction. A plurality of connecting wires interconnect each of the output ends and each of the light emitting elements. A judging component is connected to each of the connecting wires, and judges whether or not the drive signals are being normally transmitted through the connecting wire that the judging component has selected.

15 Claims, 4 Drawing Sheets

IMAGE FORMING APPARATUS, IMAGE FORMING METHOD, AND STORAGE MEDIUM IN WHICH ABNORMALITY JUDGING PROGRAM IS STORED

CROSS-REFERENCE TO RELATED APPLICATION

This application is based on and claims priority under 35 USC 119 from Japanese Patent Application No. 2009-071356 filed Mar. 24, 2009.

BACKGROUND

1. Technical Field

The present invention relates to an image forming apparatus, an image forming method, and a storage medium in which an abnormality judging program is stored.

2. Related Art

Conventionally, there has been known an image forming apparatus that uses a laser array including plural laser light emitting elements capable of emitting light simultaneously along a sub-scanning direction and is equipped with at least one photoconductor on which a toner image is formed by exposure by the laser array and development by toner.

SUMMARY

According to an aspect of the invention, there is provided an image forming apparatus. The image forming apparatus includes: an exposure component that is equipped with a plurality of independently drivable light emitting elements arrayed along a first direction and which exposes photoconductors by scanning, in a second direction intersecting the first direction, light that is emitted when the light emitting elements are driven by drive signals based on image data; an output component that is equipped with output ends corresponding to each of the light emitting elements and which, at normal times, outputs, one line at a time, drive signals of plural lines when exposure is performed in one scan by the exposure component from each of the output ends and which, when correcting an amount of misalignment in the first direction, outputs drive signals of one line corresponding to a line on a most upstream side of drive signals of plural lines from the output ends that have been shifted by a number corresponding to the amount of misalignment in the first direction; a plurality of connecting wires that interconnect each of the output ends of the output component and each of the light emitting elements of the exposure component; and a judging component that is connected to each of the connecting wires, selects at least one of the connecting wires through which the drive signals are transmitted, and judges whether or not the drive signals are being normally transmitted through the connecting wire that the judging component has selected.

BRIEF DESCRIPTION OF THE DRAWINGS

An exemplary embodiment of the present invention will be described in detail based on the following figures, wherein.

DETAILED DESCRIPTION

Below, an exemplary embodiment of the present invention will be described in detail with reference to the drawings.

Figure 1:
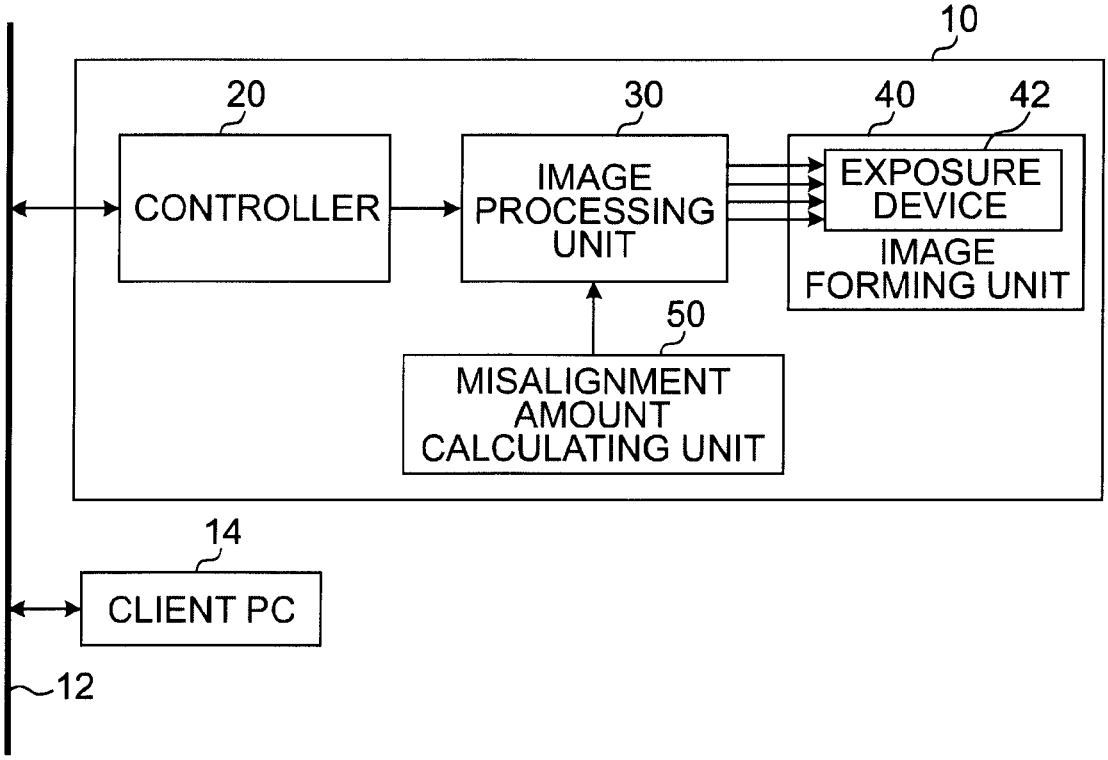
FIG. 1 is a diagram showing an environment that utilizes an image forming apparatus pertaining to the exemplary embodiment of the invention.

FIG. 1 is a diagram showing an environment that utilizes an image forming apparatus 10 pertaining to the present exemplary embodiment. The image forming apparatus 10 is connected to a network 12, and a client PC 14 is also connected to the network 12.

The image forming apparatus 10 is configured to include: a controller 20 that administers predetermined processing to and outputs image data that have been inputted; an image processing unit 30 that performs image processing such as dithering and error diffusion with respect to the image data that have been outputted from the controller 20; an image forming unit 40 that forms an image on the basis of the image data to which the predetermined processing has been administered; and a misalignment amount calculating unit 50 that calculates an amount of misalignment, in a sub-scanning direction, of the image that is formed by the image forming unit 40.

The controller 20 can be configured by a microcomputer that includes: a CPU that controls the entire image forming apparatus 10; a ROM in which various programs, various parameters and various table information are stored beforehand; a RAM that is used as a work area when the CPU executes the various programs; a page memory that stores image data that have been obtained by reading an image; and a bus that interconnects these.

Further, the controller 20 implements color space conversion, tone mapping, format conversion and compression/expansion, stores image data (PDL) that have been inputted from the client PC 14 connected via the network 12 in the page memory, and thereafter outputs the image data to the image processing unit 30 in a number of lines corresponding to a number of beams (in the present exemplary embodiment, four) of an exposure device synchronously with a page synchronization signal and a line synchronization signal.

The image forming unit 40 is an electrophotographic tandem type image forming unit that is configured by: photoconductors that rotate per color of yellow (Y), magenta (M), cyan (C) and black (K); an exposure device 42 that is equipped with plural laser beam emitters arrayed in a sub-scanning direction and which forms electrostatic latent images on the photoconductors; developing devices that develop the electrostatic latent images into toner images; an intermediate transfer belt onto which the toner images of each color that have been developed are transferred; and a fixing unit that fixes the toner images that have been transferred onto the intermediate transfer belt to paper. First, the electrostatic latent images are formed on the surfaces of the photoconductors by the exposure device 42 on the basis of image data that have been read in synch with a timing signal. The electrostatic latent images that have been formed are developed into toner images by the developing devices, the toner images of each color are transferred onto the intermediate transfer belt, and a full-color image is formed while the intermediate transfer belt completes one revolution. The full-color image that has been transferred onto the intermediate transfer belt is transferred and fixed onto a predetermined size of paper that has been conveyed, whereby an image is formed.

The misalignment amount calculating unit 50 causes a test pattern for calculating an amount of misalignment to be formed in the image forming unit 40, reads this with a reading component, outputs the read data, and calculates, on the basis of the read data, an amount of misalignment in the sub-scanning direction, such as misalignment caused by a difference in speed between the photoconductors and the intermediate transfer belt.

Figure 2:
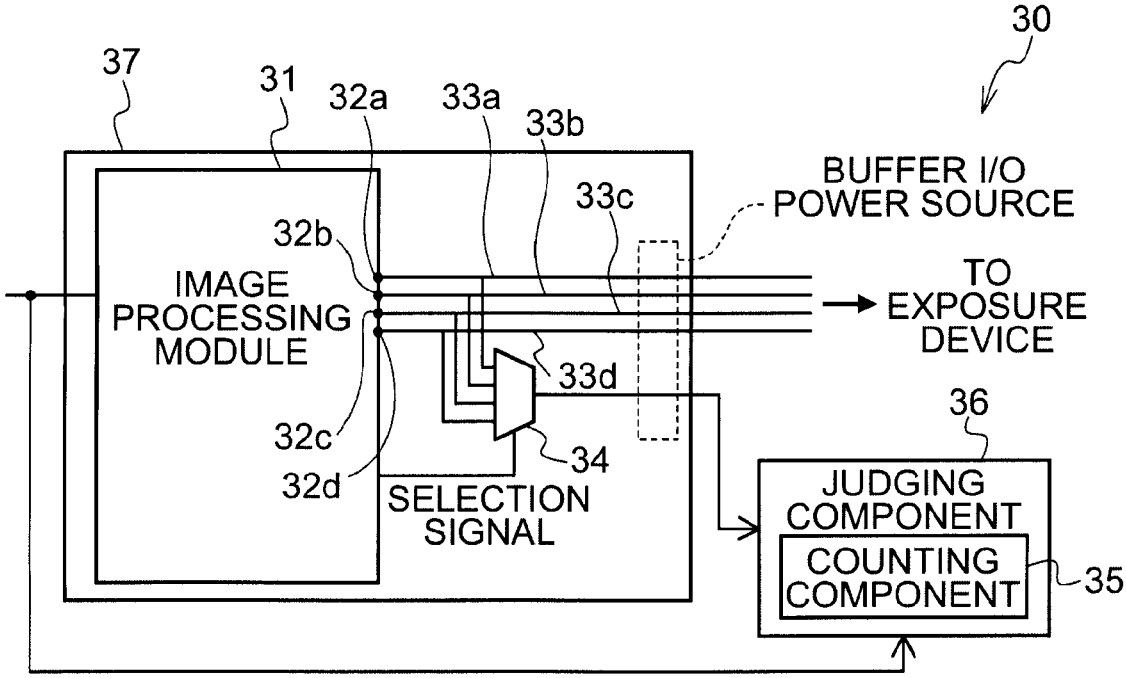
FIG. 2 is a schematic diagram showing the configuration of an image processing unit of the image forming apparatus of the exemplary embodiment of the invention.

As shown in FIG. 2, the image processing unit 30 is configured to include: an image processing module 31 that generates drive signals that drive the laser beam emitters of the exposure device 42 on the basis of the image processing such as dithering and error diffusion and the misalignment amount that has been calculated by the misalignment amount calculating unit 50; connecting wires 33*a* to 33*d* that interconnect each of output ends 32*a* to 32*d* disposed in the image processing module 31 and each of the laser beam emitters and which transmit the drive signals; a selection circuit 34 that is connected to each of the connecting wires 33 and selects one of the connecting wires 33 on the basis of a selection signal that is outputted from the image processing module 31; and a judging component 36 that includes a counting component 35 that counts ON signals of the drive signals of the connecting wire 33 that has been selected by the selection circuit 34, with the judging component 36 judging abnormality of the connecting wires 33 on the basis of the count value that has been counted by the counting component 35 and the number of pixels of the image data. The image processing module 31, the connecting wires 33 and the selection circuit 34 are configured by a logic circuit element 37 such as an application-specific integrated circuit (ASIC) or a field-programmable gate array (FPGA).

The output end 32*a* of the image processing module 31 is connected to a laser beam emitter (1) via the connecting wire 33*a*, the output end 32*b* is connected to a laser beam emitter (2) via the connecting wire 33*b*, the output end 32*c* is connected to a laser beam emitter (3) via the connecting wire 33*c*, and the output end 32*d* is connected to a laser beam emitter (4) via the connecting wire 33*d*.

Here, the relationship between correcting misalignment in the sub-scanning direction and judging abnormality of the connecting wires in the present exemplary embodiment will be described.

Figure 3B:
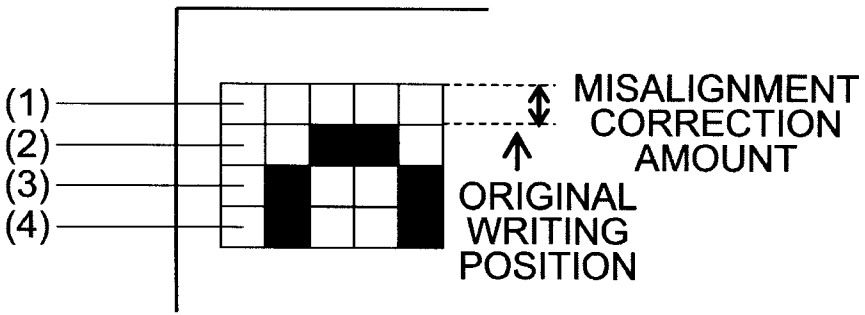
FIGS. 3A and 3B are diagrams for describing misalignment in a sub-scanning direction.
Figure 3A:
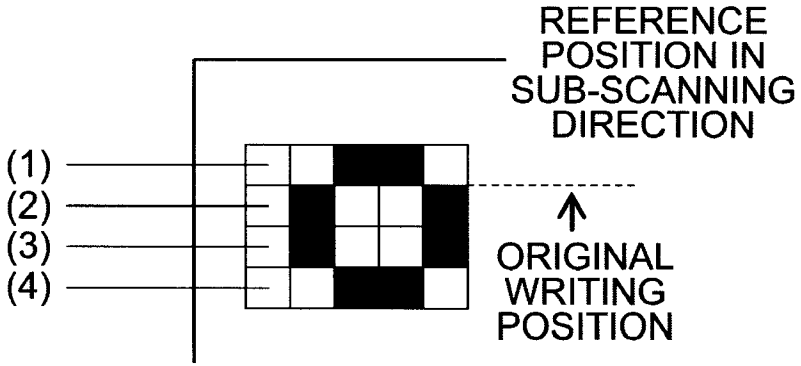

When misalignment in the sub-scanning direction is not to be corrected, exposure of the photoconductor is performed by the laser beam emitter (1) on the basis of a first line of the image data. Here, as shown in FIG. 3A, it will be assumed that misalignment in the sub-scanning direction occurs and that the image data are being written from a position shifted by one line from an original writing position. In that case, as shown in FIG. 3B, when the laser beam (2) performs exposure based on the first line of the image data, misalignment in the sub-scanning direction becomes corrected and the image data become written from the original writing position.

Further, it is common for a logic circuit element such as an ASIC or an FPGA to use plural power sources, and in the case of a circuit element that has buffer output such as drive signals based on image data, the logic circuit element includes an I/O power source for buffer output. In order to detect abnormality in the supply of that I/O power source or abnormality in buffer output, it is necessary for the logic circuit element to separately output and monitor the outputs of the connecting wires, but when the logic circuit element separately outputs the outputs of all of the connecting wires, the circuit pattern becomes complicated as the number of connecting wires increases, which leads to an increase in the number of input/output pins. Thus, the logic circuit element controls an increase in the complexity of the circuit by selecting at least one connection wire from among the plural connecting wires and monitoring the drive signals that are transmitted through the connecting wire that the logic circuit element has selected.

In this manner, when the logic circuit element selects at least one connecting wire from among the plural connecting wires, when the logic circuit element is correcting misalignment in the sub-scanning direction by shifting the laser beam emitter that performs exposure based on the first line of the image data such as mentioned above, the logic circuit element cannot correctly judge abnormality unless it selects the appropriate connecting wire. For example, when misalignment has been corrected as shown in FIG. 3B, the logic circuit element must select the connecting wire 33*b* and not the connecting wire 33*a* in order to monitor the drive signals based on the first line of the image data.

Thus, in the present exemplary embodiment, the image forming apparatus 10 operates so as to select the appropriate connecting wire on the basis of the amount of misalignment in the sub-scanning direction.

Next, operation of the image forming apparatus 10 of the present exemplary embodiment will be described.

When image data are inputted from the controller 20 to the image processing unit 30, the image processing unit 30 performs predetermined image processing such as dithering and error diffusion and thereafter converts the image data one line at a time into binarized drive signals for controlling the ON and OFF of the laser beam emitters. When the misalignment correction is not performed, the drive signals corresponding to the first line of the image data are output from the output end 32*a*. Here, the image processing unit 30 performs correction of misalignment in the sub-scanning direction as follows.

The image processing unit 30 acquires the amount of misalignment in the sub-scanning direction from the misalignment amount calculating unit 50 and converts the acquired amount of misalignment into a number of lines of the image data. Then, the image processing unit 30 shifts the output ends by a number corresponding to the converted number of lines and outputs the drive signals corresponding to the first line of the image data. For example, when the image processing unit 30 converts the amount of misalignment acquired from the misalignment amount calculating unit 50 into a number of lines and that number of lines is two, the image processing unit 30 outputs drive signals corresponding to the first line of the image data from the output end 32*c*.

Thus, in a first scan by the exposure device 42, the laser beam emitter (3) emits light on the basis of the first line of the image data, and the laser beam emitter (4) emits light on the basis of a second line of the image data. Then, in a second scan, the laser beam emitters (1) to (4) each emit light on the basis of third to sixth lines of the image data.

Meanwhile, the image processing module 31 outputs a selection signal indicating which of the connecting wires 33 is to be selected to the selection circuit 34 on the basis of the value obtained by converting the amount of misalignment acquired from the misalignment amount calculating unit 50 into a number of lines. The selection signal is a signal by which the connecting wire 33 corresponding to the writing position onward is selected because it is necessary for the selection circuit 34 to select the connecting wire 33 through which the drive signals are being transmitted. For example, as described above, when the drive signals corresponding to the first line of the image data have been outputted from the output end 32*c*, the selection signal is a signal by which the selection circuit 34 selects the connecting wire 33*c* or 33*d*.

Next, the counting component 35 of the judging component 36 counts the ON signals of the drive signals of the connecting wire 33 that has been selected. The ON signals of the drive signals are signals for causing the corresponding laser beam emitter to emit laser light, and one ON signal corresponds to one pixel of the image that is to be formed. Depending on the electrostatic latent image format of the image forming apparatus, there are also cases where the OFF signals correspond to the pixels of the image that is to be formed.

Next, the judging component 36 judges abnormality of the connecting wire 33 on the basis of the count value of the counting component 35. The connecting wire 33 through which the drive signals are being transmitted is supposed to have been selected by the selection circuit 34, so the judging component 36 judges that there is abnormality in the connecting wire 33 when the count value is 0.

Further, the controller 20 inputs to the judging component 36 the number of pixels per one page of the image data before inputting it to the image processing unit 30, and the judging component 36 judges abnormality of the connecting wire 33 by comparing that number of pixels with the count value of the ON signals of the drive signals that have been counted by the counting component 35. The number of pixels of the image data and the count value that has been counted by the counting component 35 have a proportional relationship to a certain extent, so when the ratio between the number of pixels of the image data and the count value that has been counted by the counting component 35 exceeds a threshold value, the judging component 36 can judge that there is abnormality in the connecting wire 33.

Figure 4:
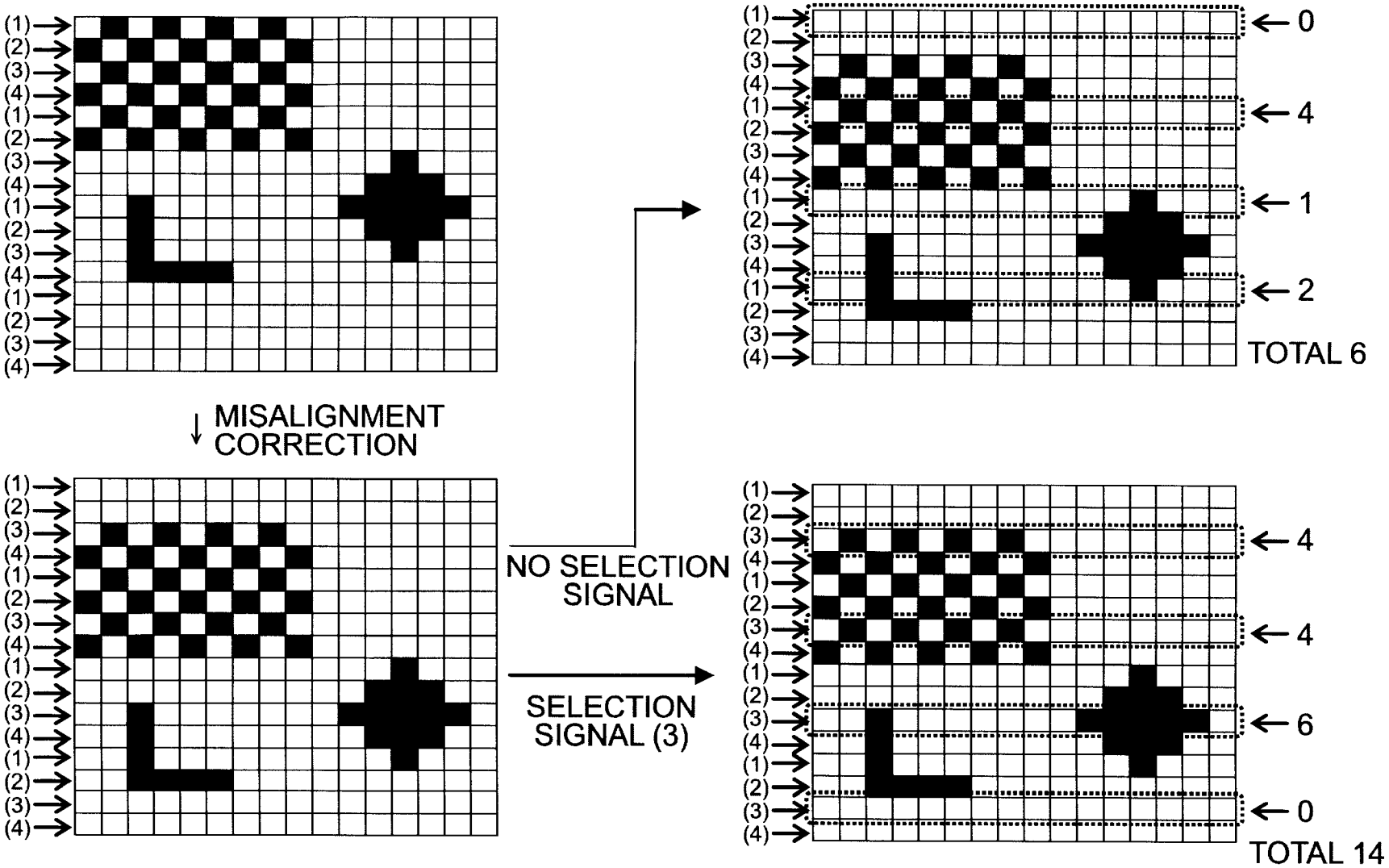
FIG. 4 is a diagram for describing a comparison between numbers of pixels and count values.

Here also, because the appropriate connecting wire 33 is selected by the selection circuit 34, a correspondence between the lines of that image data that are counted and the drive signals can be accurately achieved. For example, as shown in FIG. 4, a case will be considered where, when the image processing module 31 has outputted drive signals corresponding to the first line of the image data from the output end 32*c* corresponding to the laser beam emitter (3) because of misalignment correction, the judging component 36 compares the count value that is counted by the counting component 35 with the number of pixels of the image data that likely corresponds to the laser beam emitter (1) unless there is misalignment correction. The number of pixels of image data that likely corresponds to the laser beam emitter (1) unless there is misalignment correction is 14 pixels in one page. When the connecting wire 33 is not to be selected in consideration of misalignment correction, the drive signals that are transmitted through the connecting wire 33*a* are counted, the count value becomes six in one page, and this count value does not match the number of pixels. On the other hand, when a selection signal (3) for selecting the connecting wire 33*c* has been inputted to the selection circuit 34, the drive signals that are transmitted through the connecting wire 33*c* are counted, the count value becomes 14 in one page, and this count value matches the number of pixels.

Here, because one pixel and one ON signal correspond to each other, the number of pixels and the count value match each other, but in the case of a configuration where one pixel and one ON signal do not correspond to each other, such as when the number of pixels and the count value are in a proportional relationship such that two ON signals correspond to one pixel, the judging component 36 is configured to judge whether or not the ratio between the number of pixels and the count value is a normal value on the basis of a corresponding relationship between one pixel and one ON signal understood beforehand.

Figure 5:
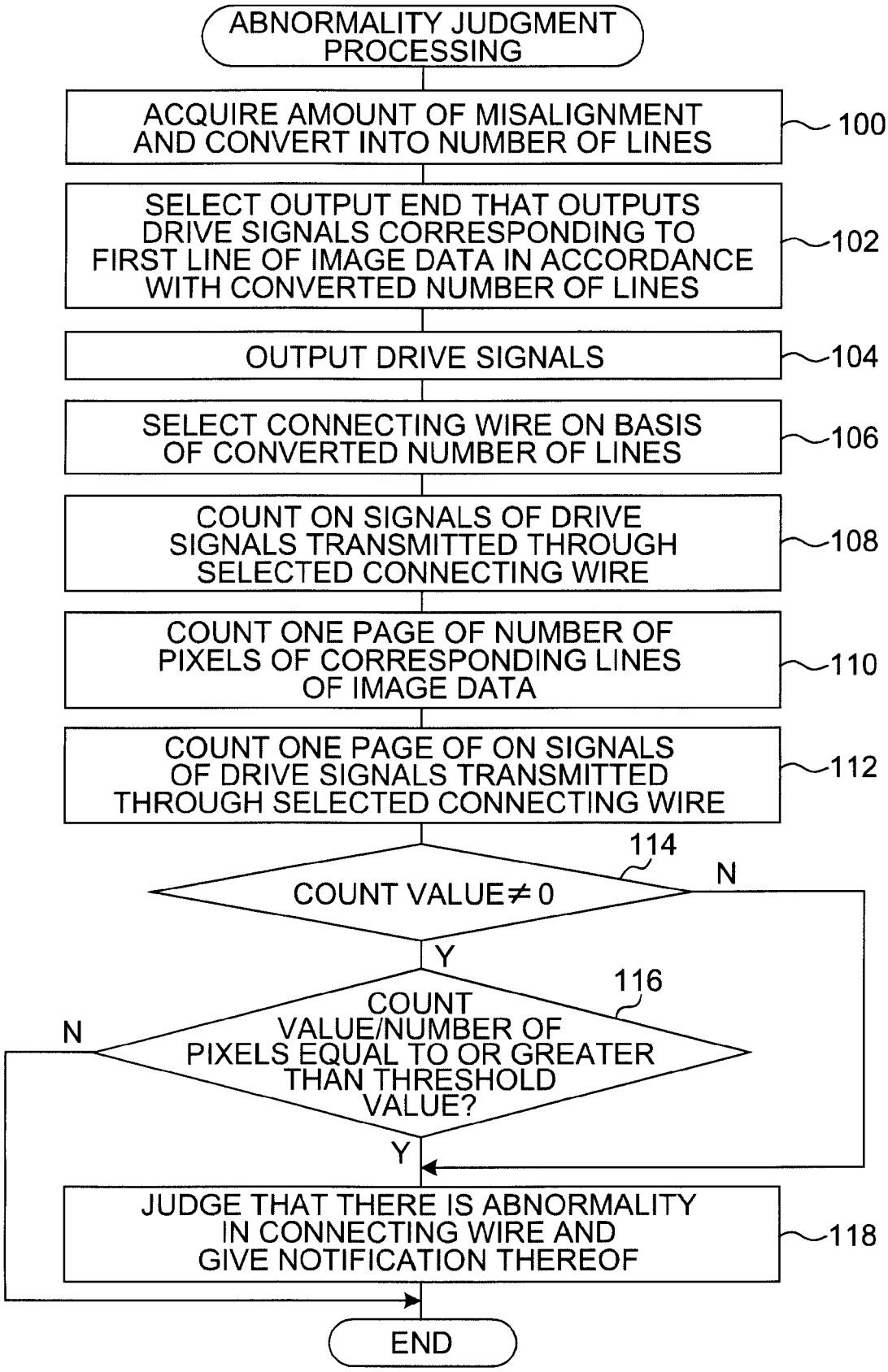
FIG. 5 is a flowchart showing the content of a processing routine of an abnormality judging program in the image forming apparatus of the exemplary embodiment of the invention.

Further, the above-described processing may be performed as a result of the CPU executing an abnormality judging program stored in the ROM. Below, a processing routine of the abnormality judging program in the image forming apparatus 10 of the present exemplary embodiment will be described with reference to FIG. 5.

In step 100, the program acquires the amount of misalignment in the sub-scanning direction and converts the acquired amount of misalignment into a number of lines of the image data. Next, in step 102, the program selects the output end 32 such that drive signals corresponding to the first line of the image data are shifted by a number corresponding to the converted number of lines and the drive signals are outputted. Next, in step 104, the program outputs the drive signals respectively from each of the output ends 32.

Next, in step 106, the program selects one of the connecting wires 33 from the connecting wires 33*a* to 33*d* in accordance with the number of lines that have been converted on the basis of the amount of misalignment and the image lines whose numbers of pixels are counted. Next, in step 108, the program counts the ON signals of the drive signals that are transmitted through the connecting wire 33 that the program has selected.

Next, in step 110, the program counts the number of pixels of one page of the corresponding image lines on the basis of the image data. Next, in step 112, the program counts one page of the ON signals of the drive signals of the connecting wire 33 that has been selected in step 106.

Next, in step 114, the program determines whether or not the count value of the ON signals that have been counted is 0. When the count value is not 0, the program proceeds to step 116. When the count value is 0, the program proceeds to step 118.

In step 116, the program determines whether the ratio between the number of pixels that have been counted in step 110 and the count value that has been counted in step 112 is equal to or greater than a threshold value. When the ratio is smaller than the threshold value, the program ends the processing. When the ratio is equal to or greater than the threshold, the programs proceeds to step 118, judges that there is abnormality in the connecting wire 33, gives notification of the judgment result by displaying a message on a display device or outputting a buzzer sound from a speaker, and ends the processing.

As described above, according to the image forming apparatus of the present exemplary embodiment, in an image forming apparatus that exposes photoconductors with an exposure device configured by plural laser beam emitters arrayed in a sub-scanning direction, even when misalignment is corrected by converting the amount of misalignment in the sub-scanning direction into a number of lines and shifting, by the converted number of lines, the laser beam emitters that are driven by drive signals corresponding to a first line of image data, an appropriate connecting wire is selected in accordance with the converted number of lines from among plural connecting wires through which the drive signals are transmitted, and ON signals of the drive signals that are transmitted through the connecting wire that has been selected are counted to judge abnormality, so the circuit can be prevented from becoming complicated in comparison to when the ON signals of the drive signals are counted in regard to all of the connecting wires. Further, the appropriate connecting wire can be selected to accurately judge abnormality of the connecting wire in comparison to when a connecting wire is selected without considering misalignment correction.

In the present exemplary embodiment, a case has been described where the laser beam emitters are arrayed in the sub-scanning direction and misalignment in the sub-scanning direction is corrected by changing the laser beam emitters, but the present invention can also be applied to a case where the laser beam emitters are arrayed in the main scanning direction and misalignment in the main scanning direction is corrected by changing the laser beam emitters.

What is claimed is:

1. An image forming apparatus comprising:

an exposure component that is equipped with a plurality of independently drivable light emitting elements arrayed along a first direction and which exposes photoconductors by scanning, in a second direction intersecting the first direction, light that is emitted when the light emitting elements are driven by drive signals based on image data;

an output component that is equipped with output ends corresponding to each of the light emitting elements and which, at normal times, outputs, one line at a time, drive signals of plural lines when exposure is performed in one scan by the exposure component from each of the output ends and which, when correcting an amount of misalignment in the first direction, outputs drive signals of one line corresponding to a line on a most upstream side of drive signals of plural lines from the output ends that have been shifted by a number corresponding to the amount of misalignment in the first direction;

a plurality of connecting wires that interconnect each of the output ends of the output component and each of the light emitting elements of the exposure component;

a selection component that selects at least one of the connecting wires that is connected to output ends, from among the output ends, that output the drive signals corresponding to the line on the most upstream side and a line that is exposed by a same scanning as a scanning by which the line on the most upstream side is exposed, when correcting the amount of misalignment in the first direction; and a judging component that is connected to each of the connecting wires, and judges whether or not the drive signals are being normally transmitted through the at least one of the connecting wires selected by the selection component.

2. The image forming apparatus of claim 1, wherein the judging component includes a counting component that counts the drive signals that are transmitted through the at least one of the connecting wires that has been selected, and when a count value is not to be counted by the counting component, or when a ratio between the number of pixels of the image data and the count value that has been counted by the counting component exceeds a threshold value determined beforehand, the judging component judges that the drive signals are not being normally transmitted through the connecting wires.

3. The image forming apparatus of claim 1, wherein the first direction is a sub-scanning direction and the second direction is a main scanning direction.

4. The image forming apparatus of claim 1, wherein the first direction is a main scanning direction and the second direction is a sub-scanning direction.

5. The image forming apparatus of claim 1, wherein the light emitting elements are laser beam emitters.

6. An abnormality judging method comprising:

(a) controlling an output component, which is equipped with output ends corresponding to each of light emitting elements of an exposure component that is equipped with a plurality of independently drivable light emitting elements arrayed along a first direction and which exposure component exposes photoconductors by scanning, in a second direction intersecting the first direction, light that is emitted when the light emitting elements are driven by drive signals based on image data, at normal times outputs, one line at a time, drive signals of plural lines when exposure is performed in one scan by the exposure component from each of the output ends and, when correcting an amount of misalignment in the first direction, outputs drive signals of one line corresponding to a line on a most upstream side of drive signals of plural lines from the output ends that have been shifted by a number corresponding to the amount of misalignment in the first direction;

(b) selecting, from a plurality of connecting wires that interconnect each of the output ends of the output component and each of the light emitting elements of the exposure component, at least one of the connecting wires that is connected to output ends, from among the output ends, that output the drive signals corresponding to the line on the most upstream side and a line that is exposed by a same scanning as a scanning by which the line on the most upstream side is exposed, when correcting the amount of misalignment in the first direction; and (c) judging, using a processor, whether or not the drive signals are being normally transmitted through the selected at least one of the connecting wires.

7. The abnormality judging method of claim 6, wherein in (c), the drive signals that are transmitted through the at least one of the connecting wires that has been selected are counted by a counting component, and when a count value is not to be counted by the counting component, or when a ratio between the number of pixels of the image data and the count value that has been counted by the counting component exceeds a threshold value determined beforehand, the method judges that the drive signals are not being normally transmitted through the connecting wires.

8. The abnormality judging method of claim 6, wherein the first direction is a sub-scanning direction and the second direction is a main scanning direction.

9. The abnormality judging method of claim 6, wherein the first direction is a main scanning direction and the second direction is a sub-scanning direction.

10. The abnormality judging method of claim 6, wherein the light emitting elements are laser beam emitters.

11. A storage medium readable by a computer, the storage medium storing a program of instructions executable by the computer to perform a function for judging abnormality, the function comprising:

(a) controlling an output component, which is equipped with output ends corresponding to each of light emitting elements of an exposure component that is equipped with a plurality of independently drivable light emitting elements arrayed along a first direction and which exposure component exposes photoconductors by scanning, in a second direction intersecting the first direction, light that is emitted when the light emitting elements are driven by drive signals based on image data, at normal times outputs, one line at a time, drive signals of plural lines when exposure is performed in one scan by the exposure component from each of the output ends and, when correcting an amount of misalignment in the first direction, outputs drive signals of one line corresponding to a line on a most upstream side of drive signals of plural lines from the output ends that have been shifted by a number corresponding to the amount of misalignment in the first direction;

(b) selecting, from a plurality of connecting wires that interconnect each of the output ends of the output component and each of the light emitting elements of the exposure component, at least one of the connecting wires that is connected to output ends, from among the output ends, that output the drive signals corresponding to the line on the most upstream side and a line that is exposed by a same scanning as a scanning by which the line on the most upstream side is exposed, when correcting the amount of misalignment in the first direction; and (c) judging whether or not the drive signals are being normally transmitted through the selected at least one of the connecting wires.

12. The storage medium of claim 11, wherein in (c), the drive signals that are transmitted through the at least one of the connecting wires that has been selected are counted by a counting component, and when a count value is not to be counted by the counting component, or when a ratio between the number of pixels of the image data and the count value that has been counted by the counting component exceeds a threshold value determined beforehand, the function judges that the drive signals are not being normally transmitted through the connecting wires.

13. The storage medium of claim 11, wherein the first direction is a sub-scanning direction and the second direction is a main scanning direction.

14. The storage medium of claim 11, wherein the first direction is a main scanning direction and the second direction is a sub-scanning direction.

15. The storage medium of claim 11, wherein the light emitting elements are laser beam emitters.

* * * * *